US005099280A

United States Patent [19]

Takemoto et al.

[11] Patent Number: 5,099,280

[45] Date of Patent: Mar. 24, 1992

[54] CLEANING UNIT OF A COPYING APPARATUS

[75] Inventors: Mitsutoshi Takemoto; Makoto Sugiura; Hiroshi Kajita, all of Osaka, Japan

[73] Assignee: Mita Industrial Co., Ltd., Osaka, Japan

[21] Appl. No.: 263,609

[22] Filed: Oct. 27, 1988

[30] Foreign Application Priority Data

Oct. 30, 1987 [JP] Japan ..... 62-279491
May 20, 1988 [JP] Japan ..... 63-124674
May 20, 1988 [JP] Japan ..... 63-124675
Sep. 29, 1988 [JP] Japan ..... 63-127571[U]

[51] Int. Cl.[5] ..... G03G 21/00; G03G 15/00; G03G 15/02

[52] U.S. Cl. ..... 355/210; 355/219; 355/296

[58] Field of Search ..... 355/200, 210, 219, 260, 355/296, 299, 211

[56] References Cited

U.S. PATENT DOCUMENTS 3,667,840 6/1972 Engel et al. ..... 355/200
4,555,173 11/1985 Iseko et al. ..... 355/200
4,556,308 12/1985 Hoppner et al. ..... 355/200
4,639,119 1/1987 Isaka ..... 355/260 X
4,708,455 11/1987 Kubota et al. ..... 355/260 X
4,803,510 2/1989 Maeda ..... 355/245 X
4,862,212 8/1989 Tanzawa et al. ..... 355/245
4,952,989 8/1990 Kawano et al. ..... 355/210

FOREIGN PATENT DOCUMENTS 0145258 6/1987 Japan ..... 355/210

*Primary Examiner*—Fred L. Braun
*Attorney, Agent, or Firm*—Koda and Androlia

[57] ABSTRACT

In a cleaning unit for a copying apparatus wherein a part of the photoreceptive drum and adjacent cleaning unit can be exposed by moving a movable part of the copying apparatus in a direction of movement at a right angle to the axis of the photoreceptive drum. This movement allows a main charger installed in the cleaning unit to be integrally loaded into and unloaded from the copying apparatus together with the cleaning unit. The cleaning unit can be opened in the state of being secured to the copying apparatus by rotating it in a direction away from the photoreceptive drum, and the main charger secured to the cleaning unit can also be opened by rotating it in the direction identical to that of the cleaning unit.

17 Claims, 16 Drawing Sheets

CLEANING UNIT OF A COPYING APPARATUS

BACKGROUND OF THE INVENTION

1. Field of the Invention

The present invention relates to an improved cleaning unit of a broad width industrial-use electrostatic process copying apparatus, and more particularly, to a mechanism for reasonably loading and unloading the cleaning unit and the main charger into and from an industrial-use electrostatic process copying apparatus.

2. Description of the Prior Art

FIGS. 18 and 19 respectively show lateral views of such an industrial-use electrostatic process copying apparatus. Of these, FIG. 18 is the simplified lateral view. FIG. 19 is the lateral view denoting a condition in which a part of the copying apparatus is opened to allow an operator to perform maintenance and inspection of a cleaning unit.

When operating this conventional copying apparatus 1, a document is conveyed by the document feeding rollers 2*a* and 2*b* A document image radiated by a light source 3 passes through a lens array 4 and is made on the surface of photoreceptive drum 5. The surface of the photoreceptive drum 5 is uniformly charged with positive load by the main charger 6. Light corresponding to the document image passing through the lens array 4 radiates positive charge. Then, charge disappears from this portion to generate a static latent image. When the portion formed static latent image passes through developing device 7 by rotation of photoreceptive drum 5, toner adheres to static latent image and eventually forms toner image.

On the other hand, copying paper placed on paper-feeding tray 8 is delivered to feed roller 11 through paper-feed roller 9 and resist roller 10. Toner image formed on the surface of photoreceptive drum 5 is transferred to copying paper while the copying paper passes through transfer device 13 between photoreceptive drum 5 and transfer charger 12.

Copying paper bearing toner image then passes through fixing device 14 so that toner image can be fixed. Then, copying paper is transferred to paper-discharge tray 16*a* via paper-discharge roller 15.

Resist roller 10 is composed of the upper resist roller 10*a* and the lower resist roller 10*b*. Feed roller 11 is composed of the upper feed roller 11*a* and the lower feed roller 11*b*.

Cleaning unit 16 is installed to a position close to external surface of photoreceptive drum 5 for cleaning it by scraping off residual toner from external surface of photoreceptive drum 5.

Cleaning unit 16 and main charge 6 are independently installed to the conventional industrial-use copying apparatus 1 described above. As a result, in order to perform maintenance and inspection of cleaning unit 16 and main charger 6, copying apparatus is divided into two parts, i.e., stationary part la and movable part l*b*, as indicated by dotted line 17. Movable part l*b* can be moved to the position indicated by two-dot chained line of FIG. 19. When movable part 1*b* moves, both the cleaning unit 16 and main charger 6 are externally exposed for removal outside of copying apparatus.

Namely, paper-discharge tray 16*a*, paper-discharge roller 15 and transfer device 13 are provided on the movable part 1*b*. Additionally, parts of elements of the paper-conveying path (a part of a body of copying apparatus) being composed of lower feed roller 11*b*, transfer charger 12, upper resist roller 10*a* and the like are provided on said movable part 1*b*. Opening 18 is formed by transferring the movable part 1*b* at a right angle to the axis of photoreceptive drum 5, and thus, cleaning unit 16 can be extracted in the direction of the arrow 19. Main charger 6 can also be extracted in the arrowed direction 20.

As mentioned above, on any conventional industrial-use copying apparatus, opening 18 is generated by slidably moving of the movable part 1*b* which constitutes a part of the body of the coping apparatus. Since either cleaning unit 16 or main charger 6 must discretely be taken out of opening 18 or loaded into copying apparatus through opening 18, operator is obliged to execute double handling operations.

Furthermore, as shown in FIG. 19, since main charger 6 is installed to a specific position hardly discernible from opening 18, operator is obliged to blindly install lengthy main charger 6 to a specific position close to photoreceptive drum 5. This is a major setback, which may cause damage to photoreceptive element on the surface of photoreceptive drum 5.

SUMMARY OF THE INVENTION

The primary object of the present invention is to simplify the process needed for loading and unloading cleaning unit and main charger and prevent surface of photoreceptive drum from incurring damage by integrally combining the main charger with cleaning unit so that installation of the main charger can be completed simultaneous with loading and unloading of the cleaning unit.

On the other hand, normally, the main charger is cleaned at short cyclic intervals when compared with the cleaning intervals of the cleaning unit 16, and yet, cleaning can be done simply. Thus, the operator has always to take out main charger 6 together with cleaning unit 16 whenever he needs to clean main charger 6, which results in the lowered operating efficiency.

To compensate for this, the second object of the present invention is to allow operator to easily clean only main charger 6 by holding cleaning unit 16 in the state of being secured to copying apparatus.

It is desirable that efficiency of maintenance and inspection be improved by allowing both the main charger 6 and the cleaning unit 16 to integrally be removed from the copying apparatus.

To achieve this, the third object of the present invention is to provide a reasonable mechanism which allows an operator to easily clean the main charger by holding the cleaning unit 16 in the state of being secured to the copying apparatus and also take out the main charger together with the combined cleaning unit from the copying apparatus.

Nevertheless, as shown in FIG, 18 and 19, when an operator tries to clean the main charger 6 which is combined with the cleaning unit 16, since the opening of a case 6' of the main charger 6 is provided in the direction of the axis of the photoreceptive drum 5, the operator cannot clean the main charger 6 in this condition.

Consequently, the opening should be turned in the external direction by rotating the main charger 6. However, even if the operator tries to open up the main charger 6 by rotating it, due to disturbance of the cover of the light source 3, the operator cannot do it at all.

To compensate for this, the fourth object of the present invention is to provide a mechanical constitution which allows an operator to securely open up the main charger 6 in the condition of being loaded inside of the copying apparatus without incurring disturbance of other component parts.

To achieve the first object, the invention provides first means which is composed of the following:

A cleaning unit of a copying apparatus which allows a part of a photoreceptive drum and a cleaning unit located adjacent to said drum to externally expose themselves by causing a part of the copying apparatus to move itself in the direction at a right angle apart from the axis of the photoreceptive drum, wherein the main charger is integrally combined with the cleaning unit so that the main charger can integrally be loaded into or unloaded from the copying apparatus together with the cleaning unit.

To achieve the second and fourth objects, the present invention provides a second means which is composed of the following:

A constitution for installing cleaning unit of a copying apparatus which allows a part of a photoreceptive drum and a cleaning unit located adjacent to said drum to be externally exposed by causing a part of the copying apparatus to move itself in the direction at a right angle to the axis of the photoreceptive drum wherein comprising; a shaft which is secured to the cleaning unit and freely slides in the longitudinal direction of the cleaning unit and freely rotates; a main charger which is installed to be able to rotate itself pivoting the shaft; energizing means for constantly energizing the shaft in one of longitudinal directions of the cleaning unit; shaft-positioning means which sets the contact position of the shaft causing by the energizing means at two stages, shaft-engaging and disengaging means which allows both ends of the shaft to be engaged when the shaft is set to one of the contact position and to be disengaged when the shaft is set to the other contact position; and connector means which is installed to an end of the main charger and inserted into the socket of the copying apparatus when the main charger is set to the former contact position together with the shaft so that the main charger can securely be fixed in position.

To achieve the third and fourth objects, the present invention provides third means which is composed of the following:

A cleaning unit of a copying apparatus which allows a part of a photoreceptive drum and a cleaning unit located adjacent to said drum to be externally exposed themselves by causing a part of the copying apparatus to move itself in the direction at a right angle to the axis of the photoreceptive drum, wherein the cleaning unit is installed to the copying apparatus so that it can freely be loaded into and unloaded from the copying apparatus and freely rotates itself; and a main charger is rotatably installed to the cleaning unit so that the main charger can be opened by rotating it in the same direction as the cleaning unit's rotating direction when the cleaning unit is opened by the rotating in the direction apart from the photo-receptive drum.

DETAILED DESCRIPTION OF THE PREFERRED EMBODIMENTS

Referring now more particularly to FIG. 1 through 17, preferred embodiments of the cleaning unit related to the present invention will be described for better understanding of the invention.

Those preferred embodiments shown hereinbelow are merely examples of the invention, and thus, these by no means restrict the spirit and claims of the invention.

Figure 1:
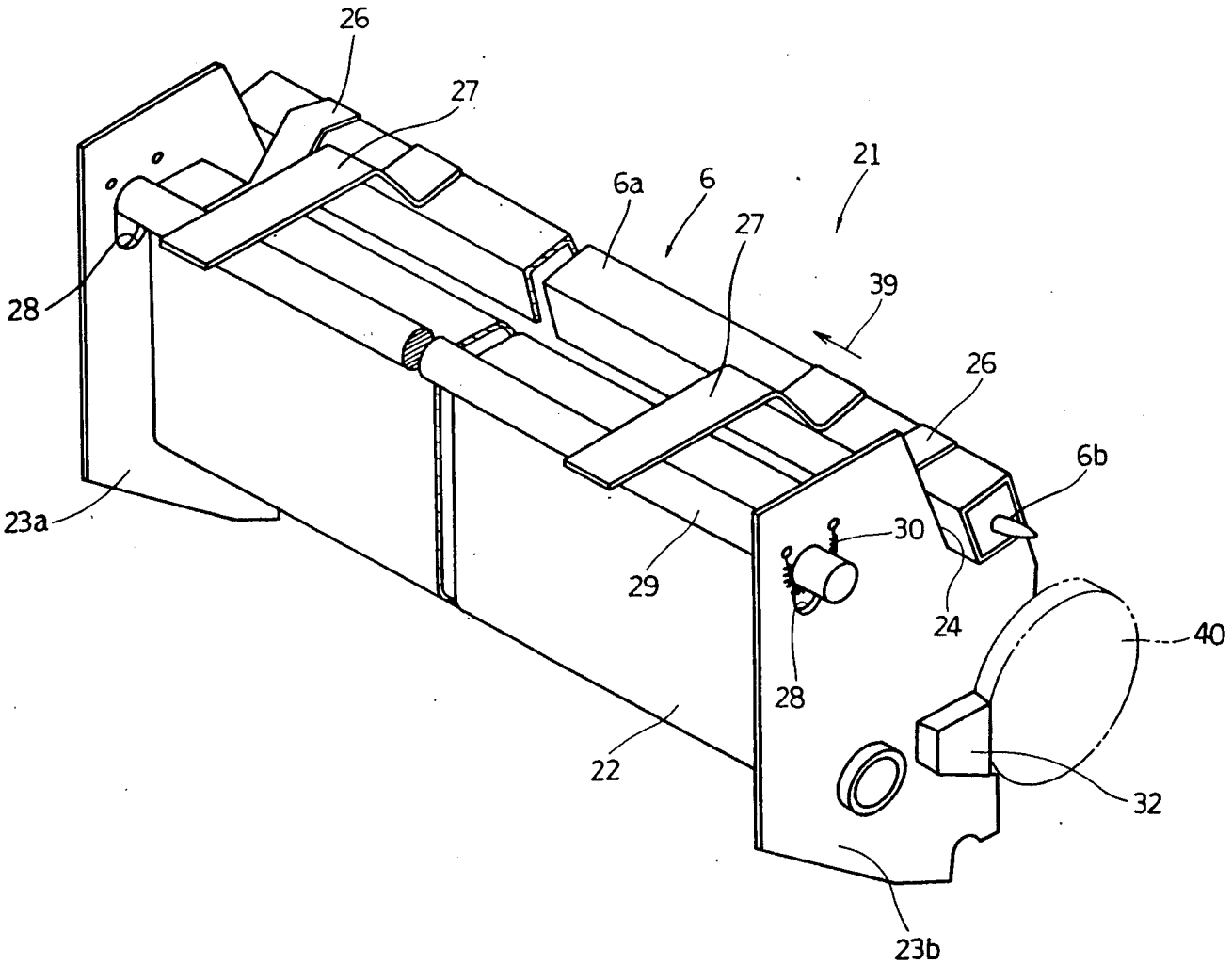
FIG. 1 is the perspective view of a preferred embodiment of the cleaning unit related to the present invention.
Figure 2:
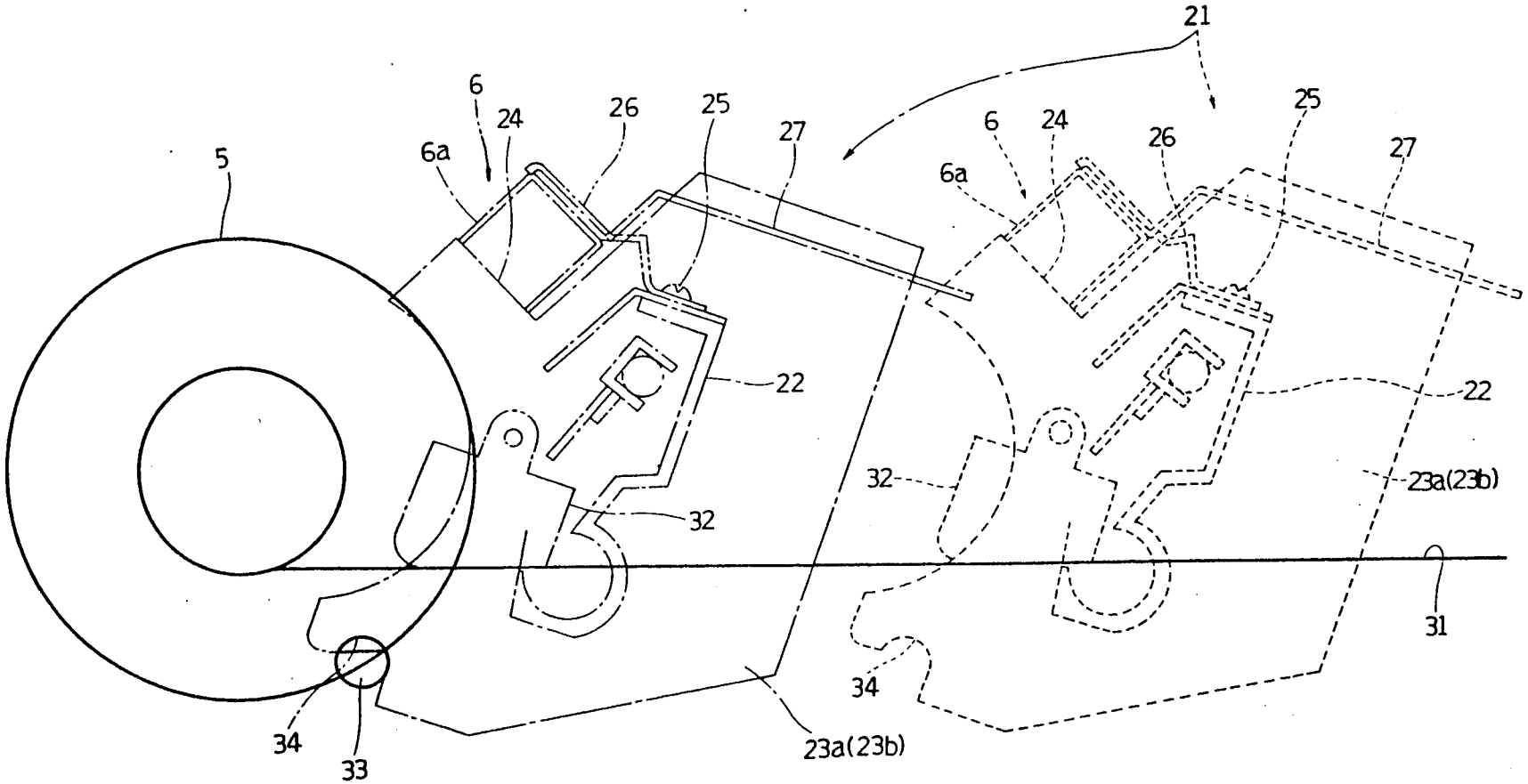
FIG. 2 is the lateral view showing the action for setting the cleaning unit to a position close to a photoreceptive drum.
Figure 19:
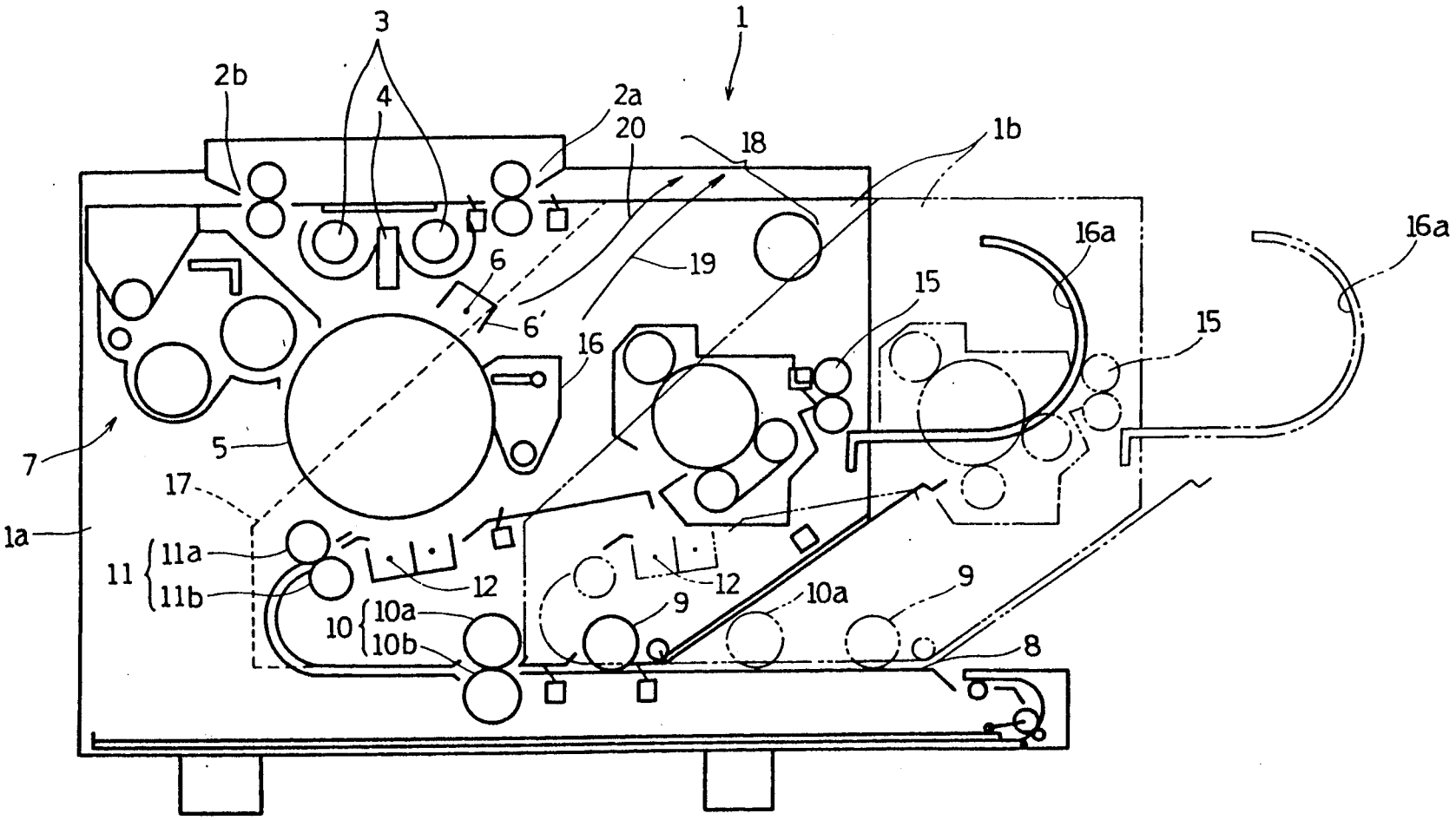

As shown in FIGS. 1 and 2, the cleaning unit 21 related to the first preferred embodiment is provided with the side plates 23*a* and 23*b* sandwiching the cleaning unit body 22. The side plates 23*a* and 23*b* are respectively provided with the cutout portion 24 for mounting the main charger 6. A pair of the charger-holders 26 and 26 substantially composed of a plate spring are secured to the upper surface of the cleaning unit body 22 with the screw 25. These charge-holders 26 and 26 support the main charger 6 freely slidable in the longitudinal direction of the cleaning unit body 22. The handles 27 and 27 allow an operator to manually transfer the main charger 6. The lengthy holes 28 and 28 are respectively provided for said side plates 23*a* and 23*b*. The shaft 29 is inserted into these lengthy holes 28 and 28 so that it can freely slide itself. The spring 30 constantly and elastically energizes said shaft 29 in the direction of the upper end of the lengthy hole 28. The frame 1*a*' of the stationary part la of the copying apparatus shown in FIG. 19 are respectively provided with horizontal guide rails 31 and 31 as shown in FIG. 2. The guide pieces 32 and 32 slide to come into contact with said guide rails 31 and 31, while these guide pieces 32 and 32 are respectively secured to the external surface of said side plates 23*a* and 23*b*.

The engaging portions 34 and 34 engaging themselves with the supporting pins 33 and 33 on both sides of said stationary part la are provided at the lower end of said side plates 23*a* and 23*b*.

Figure 3:
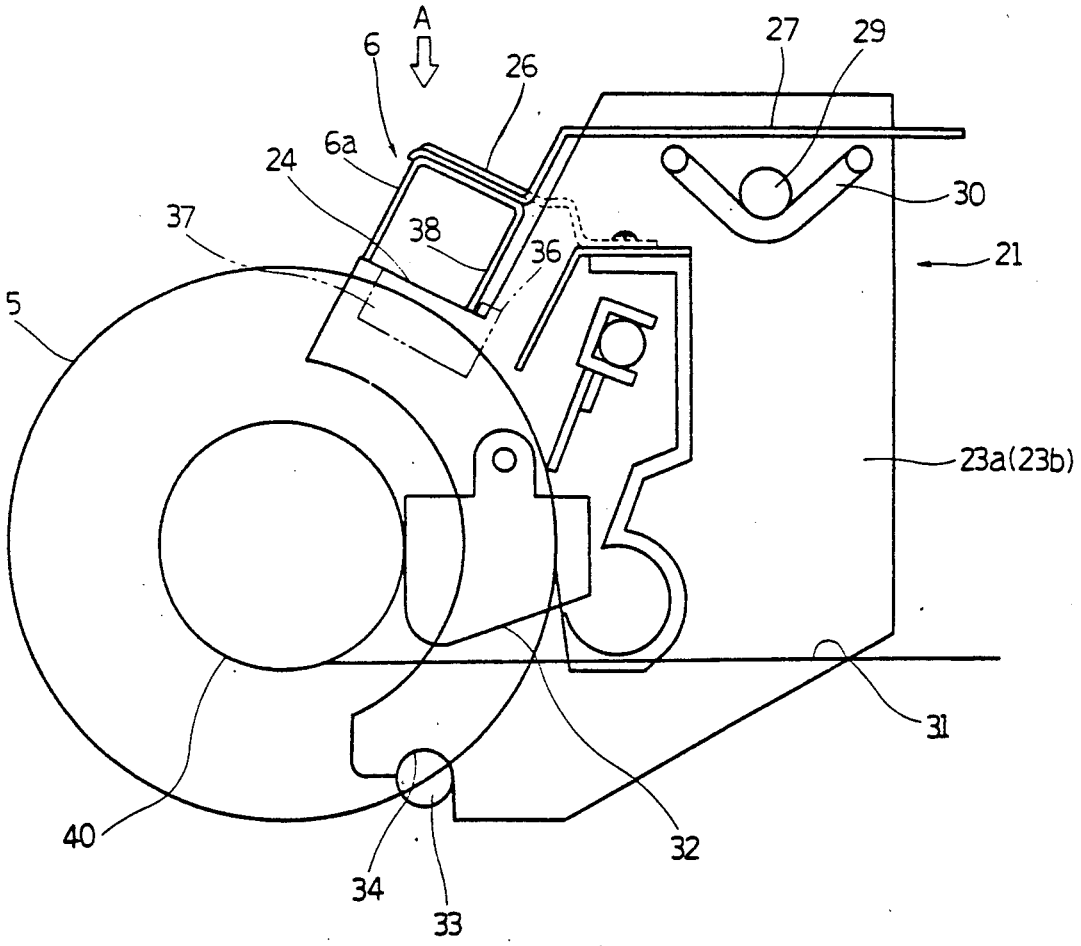
FIG. 3 is the lateral view showing the state in which the cleaning unit is set to a position close to the photoreceptive drum.
Figure 4:
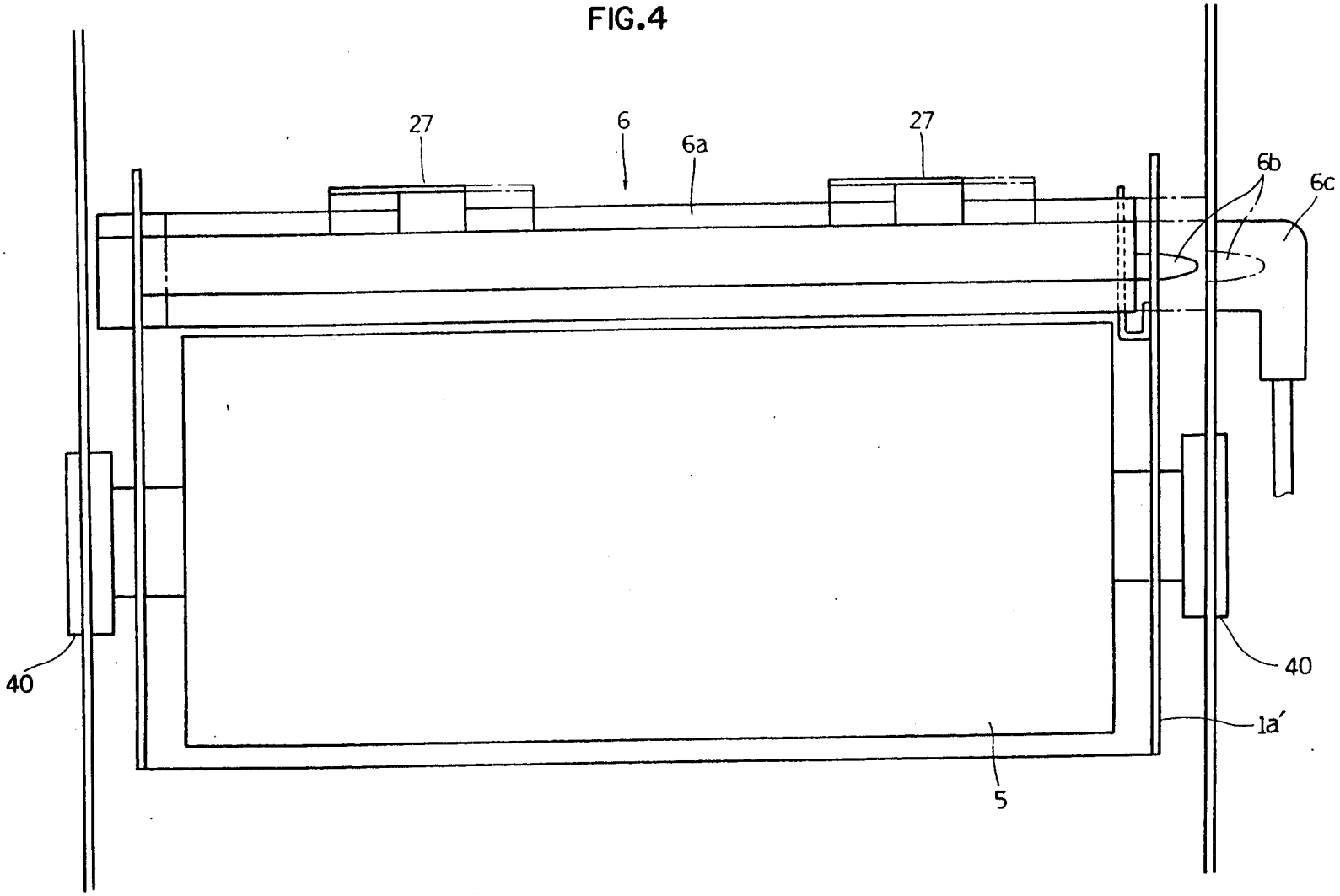
FIG. 4 is the constituents view of the part indicated by arrow A of FIG. 3.
Figure 5:
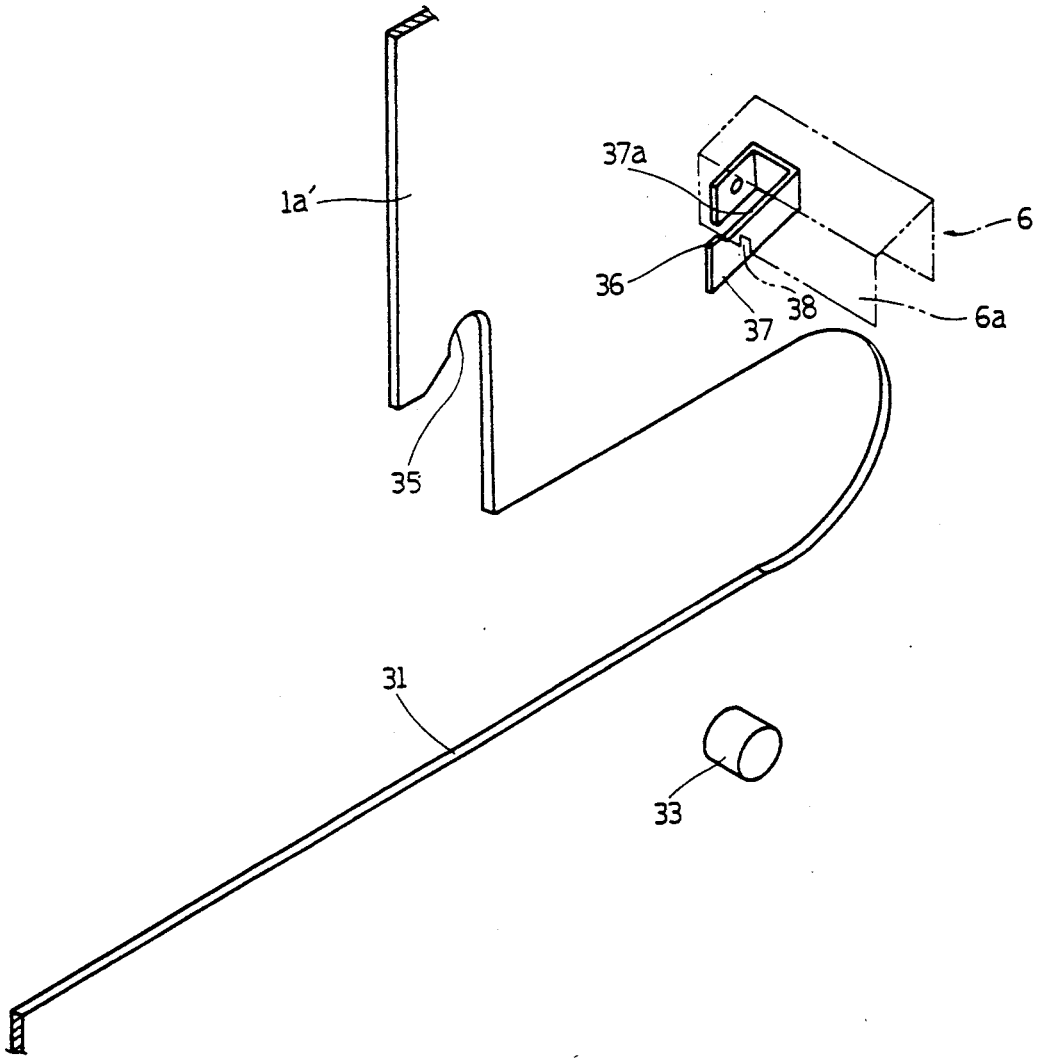
FIG. 5 is the perspective view of a mechanism for preventing the cleaning unit from falling itself off.

The cutout portions 35 and 35 for accommodating said shaft 29 are provided for the frame 1*a*' of said stationary part 1*a* as shown in FIG. 5. In addition, as shown in FIGS. 3, 4, and 5, the control member 37 having the projected portion 36 at its tip portion is secured to said frame 1*a*' of the copying apparatus. The upper surface 37*a* of said control member 37 is set to a position where the bottom of the shielding case 6*a* of the main charger 6 comes into contact with the upper surface 37*a* when inserting the terminal 6*b* (shown in FIG. 1 of the main charger 6 to the connector of the copying apparatus by causing the main charger 6 in the set position to slide itself in the longitudinal direction.

As shown in FIG. 5, the cutout portion 38 is provided at the edge of said shielding case 6*a*, where the cutout portion 38 faces said projected portion 36 when the main charger 6 is placed on the cutout portion 24.

Next the sequential procedure for loading the cleaning unit 21 and the main charger 6 above said into the copying apparatus is described below.

As shown in FIG. 1, first, an operator manually mounts the main charger 6 above the side plates 23*a* and 23*b* of the cleaning unit 21 which is disengaged from the copying apparatus. Operator then mounts the main charger 6 on the cutout portion 24 formed on the upper side of said side plates 23*a* and 23*b*. The operator then inserts said main charger 6 between the charger-holder 26 and said cutout portion 24. While this state is present, the handles 27 and 27 respectively remain in contact with the upper surface of the shaft 29 as shown in FIG. 1.

When this state is present, the operator manually slides the main charger 6 in the arrowed direction 39 shown in FIG. 1 until it comes into contact with a stopper (not shown), and then, he determines the position of the main charger 6.

Next, the operator manually raises the cleaning unit 21, and then loads it into the copying apparatus of which the movable part 1*b* remains open as shown in FIG. 19.

Concretely, as indicated by dotted line of FIG. 2, the cleaning unit 21 is installed by causing the guide pieces 32 and 32 of the side plates 23*a* and 23*b* to come into contact with the guide rails 31 and 31 installed on the frame 1*a*' of the copying apparatus.

Next, the operator slides the cleaning unit 21 in the direction of the photoreceptive drum 5 while allowing said guide pieces 32 and 32 to remain in contact with the guide rails 31 and 31. This causes the engaging portions 34 and 34 on the side plates 23*a* and 23*b* to be engaged with the supporting pins 33 and 33. This state is shown in FIG. 2 by means of one-dot chained line.

When the engaging portions 34 and 34 are engaged with the supporting pins 33 and 33, the operator then turns the cleaning unit 21 in the counterclockwise direction pivoting said supporting pins 33 and 33 as shown in FIG. 2. Then, as shown in FIG. 5, the shaft 29 is inserted through said cutout portions 35 and 35 of the frame 1*a*' of the copying apparatus. Then, the shaft 29 is compulsorily inserted into the cutout portion 35 by elastic force generated by the spring 30 so that the cleaning unit 21 can be held by the frame 1*a*' via the shaft 29.

Since a lateral surface of said guide pieces 32 remains in contact with the bearing 40 supporting the photoreceptive drum 5 when the cleaning unit 21 is loaded as shown in FIG 3, the position of the cleaning unit 21 in set in a condition which is securely determined.

On the other hand, when disengaging the shaft 29 from the cutout portions 35 and 35 by lowering position of the shaft 29 in resistance against push-up force of the spring 30, the cleaning unit 21 can be rotated in the clockwise direction pivoting the supporting pin 33 as shown in FIG. 2.

When rotating said cleaning unit 21 and pivoting the supporting pin 33, the projected portion 36 of the control member 37 on the part of the frame 1*a*' interferes with the shielding case 6*a* of the main charger 6. Nevertheless, when this state is present, since the cutout portion 38 formed on said shielding case 6*a* is in a position opposite to said projected portion 36, the projected portion 36 internally passes through said cutout portion 38, and no interference takes place.

When the cleaning unit 21 is secured to the predetermined position against the photoreceptive drum 5 as shown in FIG. 3, the projected portion 36 of said control member 37 is at the position where it remains in contact with a external side surface of the shielding case 6*a*. While this state is present, the operator can manually operate the handles 27 and 27 to move the main charger 6 in the direction opposite from arrowed direction 39 shown in FIG. 1. Movement of the main charger 6 allows its terminal 6*b* to be connected to the connector 6*c* on the part of the copying apparatus. Since said cutout portion 38 simultaneously moves from the position facing the projected portion 36, this projected portion 36 directly comes into contact with the external side surface of the shielding case 6*a*.

As mentioned above, when the terminal 6*b* of the main charger 6 is inserted into the connector 6*c* on the part of the copying apparatus, even if the operator tries to extract the cleaning unit 21 by rotating it in the clockwise direction as shown in FIG. 3 after disengaging the shaft 29 from the cutout portion 35, the projected portion 36 remains engaged with the external side surface of the shielding case 6*a* to inhibit rotation of the cleaning unit 21. This prevents the operator from erroneously removing the cleaning unit 21 while the terminal 6*b* is being inserted in the connector 6*c*.

Figure 18:
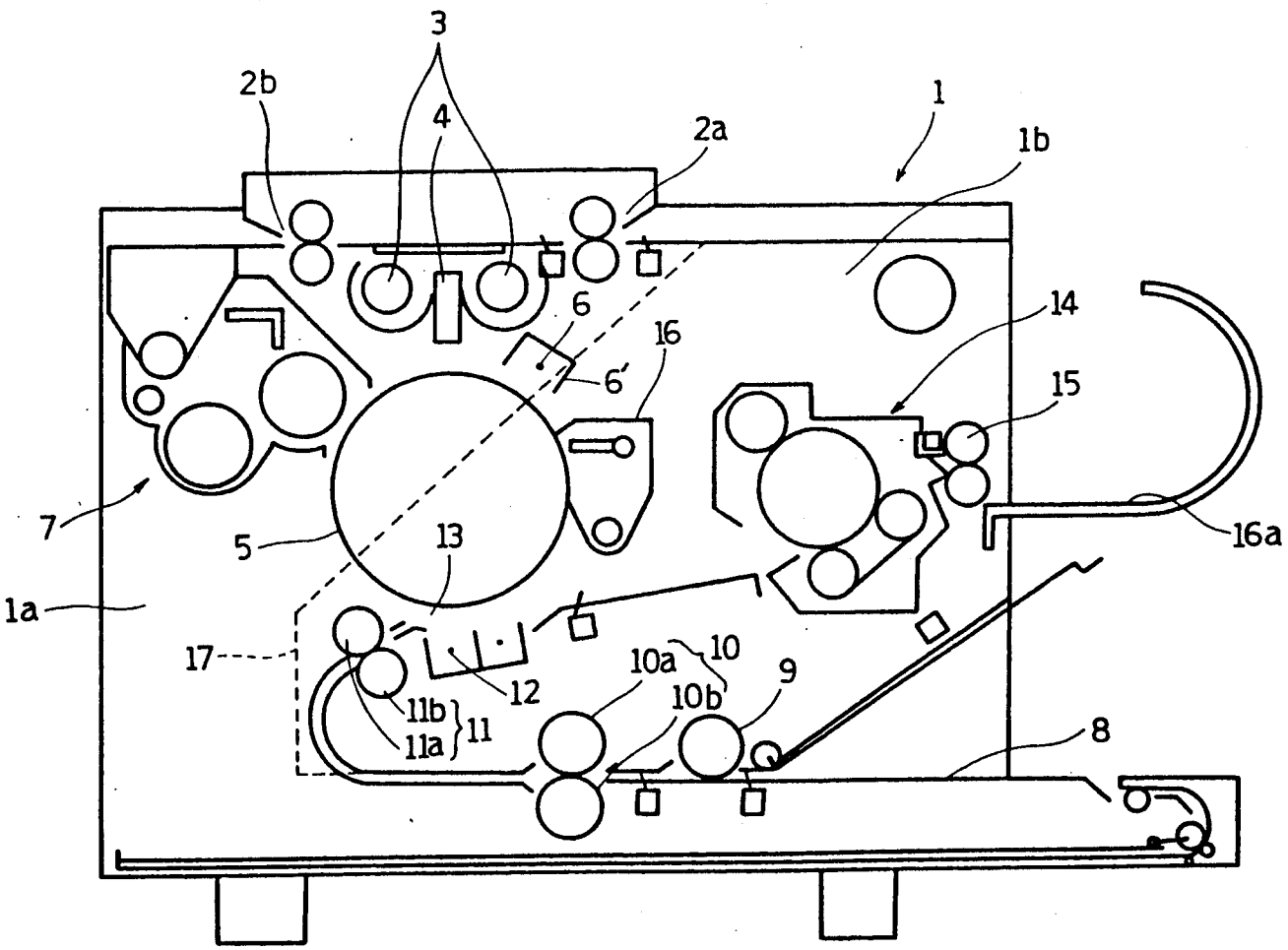
FIG. 18 is the simplified sectional view of a conventional industrial-use copying apparatus before opening the main body; and, FIG. 19 is the simplified sectional view of a conventional industrial-use copying apparatus after opening the main body.

After securing the cleaning unit 21 to a specific position about the photoreceptive drum 5, the movable part 1b in the open state as shown in FIG. 19 is closed as shown in FIG. 18. This allows copying operation to be resumed.

As mentioned above, before closing the movable part 1b, the main charger 6 must correctly be connected to the connector 6c. To achieve this, it is desirable to inhibit closing operation by causing a part of the movable part 1b to come into contact with the main charger 6 and the handle 27 when closing the movable part 1b while the main charger 6 is at a position incorrectly being connected to the connector 6c. In this case, if the main charger 6 is correctly connected to the connector 6c, the part of the movable part 1b passes through a cutout portion (not shown) of the main charger 6 or smoothly moves without being interfered by the handle 27.

The main charger 6 and the cleaning unit 21 are removed from the copying apparatus in the integrated form merely by reversing those operations mentioned above.

As mentioned above, the above preferred embodiment integrally combines the main charger 6 with the cleaning unit 21 and allows the cleaning unit 21 to move to a position where it is engaged with the supporting pin 33, and then, the cleaning unit 21 can be secured to the predetermined position merely by allowing the operator to manually raise it. The combined unit composed of the main charger 6 and the cleaning unit 21 can securely be connected to the copying apparatus merely by sliding the main charger 6 in the state mentioned above. Consequently, the above preferred embodiment dispenses with troublesome process otherwise needed for discretely loading and unloading the cleaning unit 21 and the main charger 6 into and from the copying apparatus. Furthermore, the operator can easily and securely load the main charger 6 which should be installed to a hardly discernible position, and thus, the above preferred embodiment eliminates potential risk of damaging the photoreceptive drum caused by unwanted contact with the main charger.

By virtue of the mechanical constitution of the cleaning unit of the above preferred embodiment, loading and unloading of the cleaning unit 21 and the main charger 6 can easily by done merely by loading and unloading the cleaning unit, and as a result, efficiency in the execution of a maintenance and a inspection can be improved. Furthermore, the operator can freely perform the maintenance and the inspection in an open and broad location, thus promoting operating efficiency. Compared to the case of loading and unloading the main charger alone, the operator can drastically promote convenience for handling the main charger which should be installed to a hardly discernible position. As a result, the potential risk of incurring damage to the photoreceptive drum caused by unwanted contact with the main charger is eliminated.

Referring now to FIGS. 6 through 11, another preferred embodiment of the cleaning unit related to the invention is described below.

Figure 8:
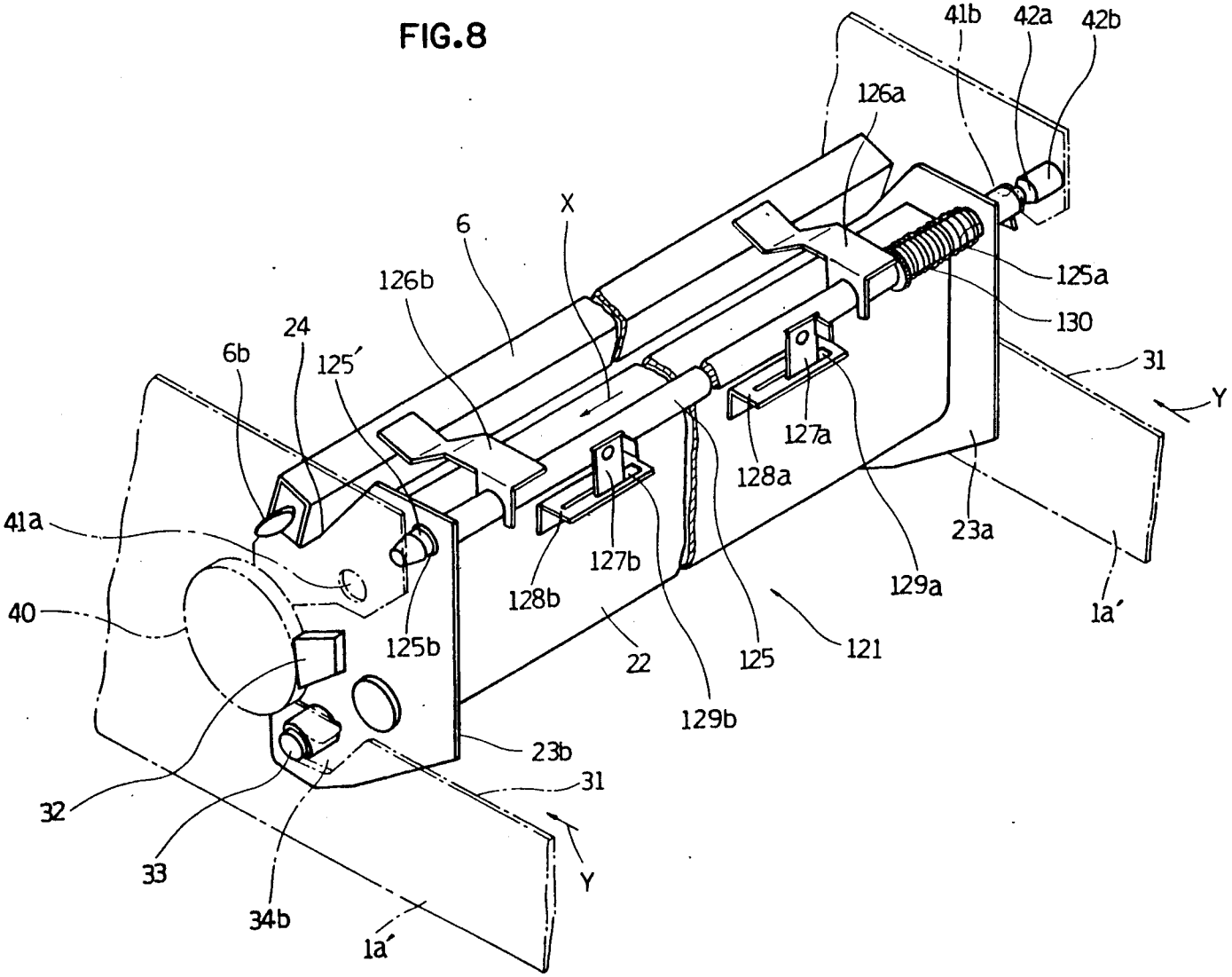
FIG. 8 is the perspective view of the cleaning unit denoting the condition of loading operation in the copying apparatus.

As shown in FIG. 8, the cleaning unit 121 related to this preferred embodiment is also provided with the side plates 23a and 23b sandwiching the cleaning unit body 22. The side plates 23a and 23b are respectively provided with the cutout portions 24 and 24 for mounting the main charger 6.

In addition, said side plates 23a and 23b are respectively provided with the supporting holes 125a and 125b which support the shaft 125 which freely slides in the longitudinal direction and freely rotates. The main charger 6 is secured to the tip ends of a pair of the brackets 126a and 126b which are rotatably installed to said shaft 125. However, these brackets 126a and 126b cannot slide themselves in the longitudinal direction of the shaft 125.

The main charger 6 can integrally be taken out of the cleaning unit 121 together with the brackets 126a and 126b. A pair of the handles 127a and 127b are used for sliding said shaft 125. These handles 127a and 127b are idly inserted in the guide slits 129a and 129b of the brackets 128a and 128b of the cleaning unit body 22 so that said shaft 125 can be moved in the longitudinal direction.

Figure 9A:
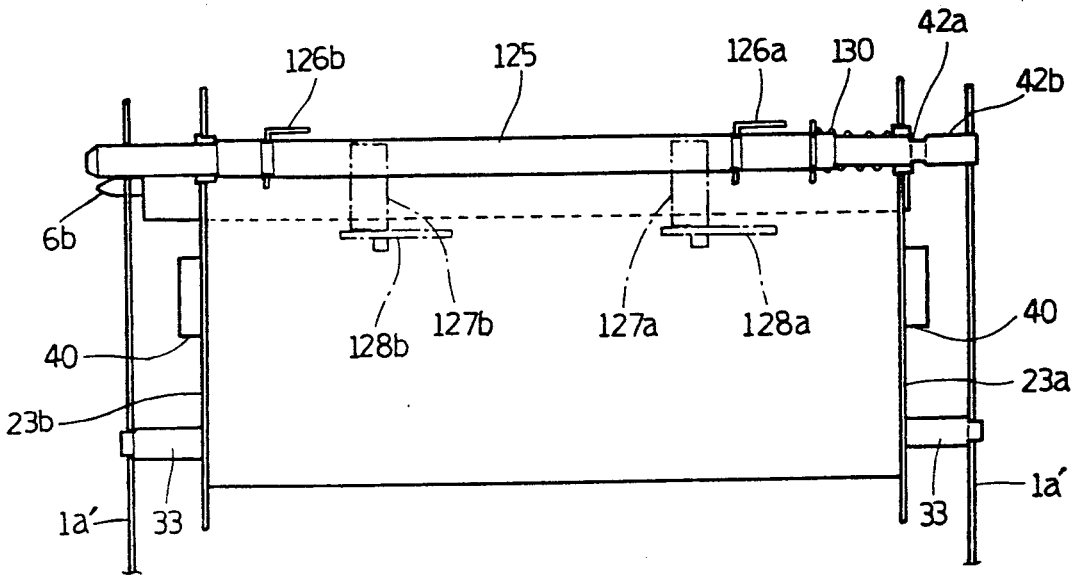
FIG. 9 (*a*) and 9 (*b*) are respectively the plane views for explaining the setting operation of the main charger.
Figure 9B:
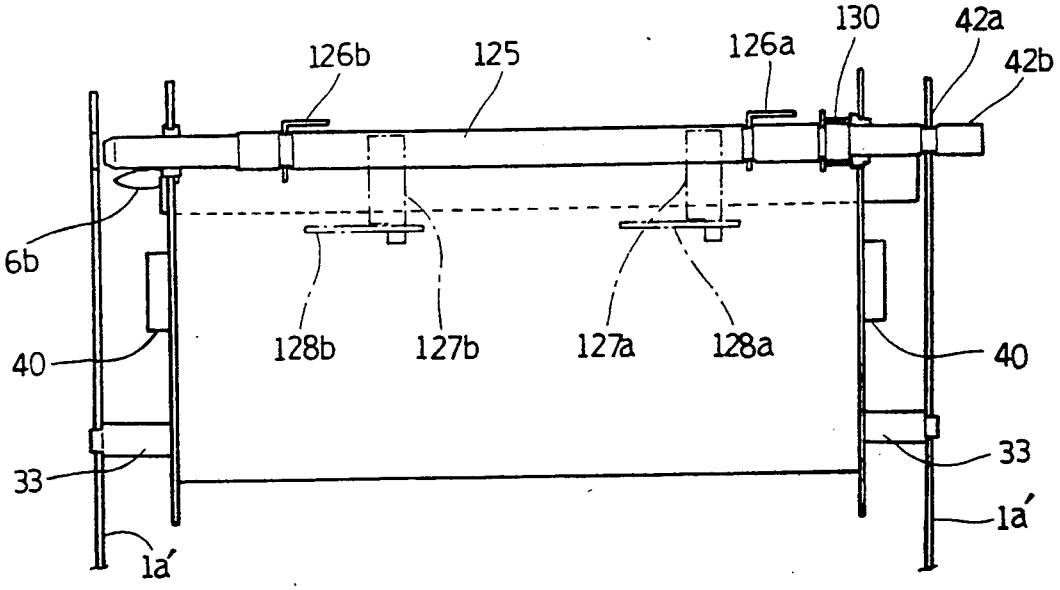
Figure 10A:
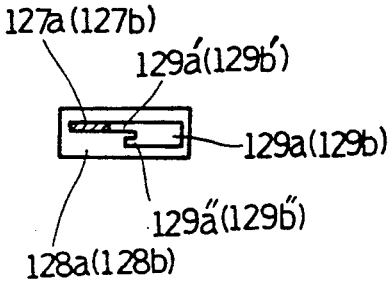
FIG. 10 (*a*) and 10 (*b*) are respectively the plane views of the coupling parts for explaining an engaging action of the main charger.
Figure 10B:
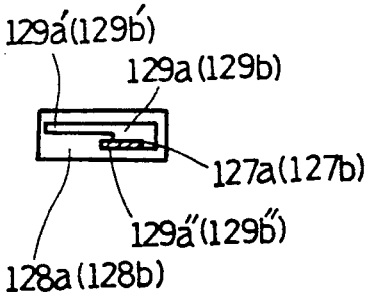

The guide slits 129a and 129b are respectively composed of the lengthy slits 129a' and 129b' and the short slits 129a'' and 129b'' shown in FIG. 10 (a) and (b). The lengthy slit 129a' (129b') is provided with a longer length than that of the short slit 129a'' (129b''). The shaft 125 moves in the arrowed direction X shown in FIG. 8 by a long distance when the handle 127a (127b) is coupled to the lengthy slit 129a' (129b') rather than being coupled to the short slit 129a'' (129b''). FIG. 9 (a) represents the condition in which the handle 127a (127b) is deeply inserted into the bosom of the lengthy slit 129a (127b). FIG. 9(b) represents the state in which the handle 127a (127b) is inserted into the bosom of the short slit 129a'' (129b'').

The shaft 125 is elastically energized by the spring 130 (energizing means) in the arrowed direction X shown in FIG. 8.

Figure 6B:
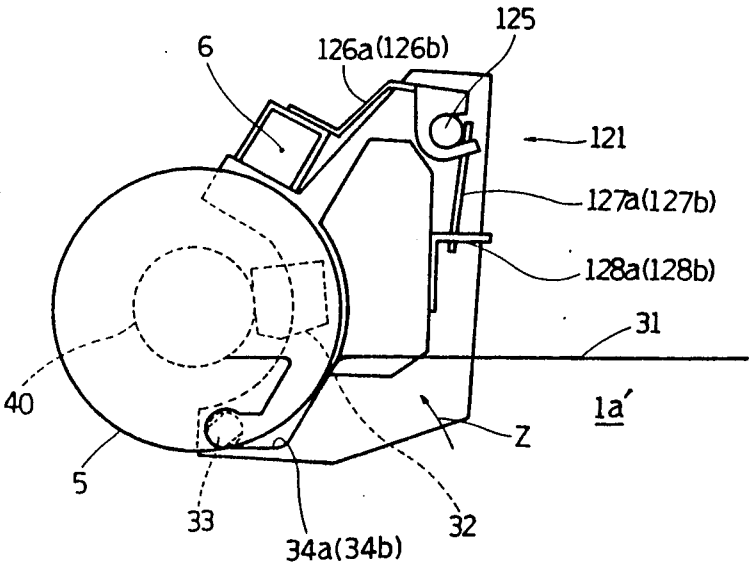
FIG. 6 (*a*), and 6 (*b*) are respectively the lateral views denoting operation conditions of another preferred embodiment of the cleaning unit related to the present invention.
Figure 7B:
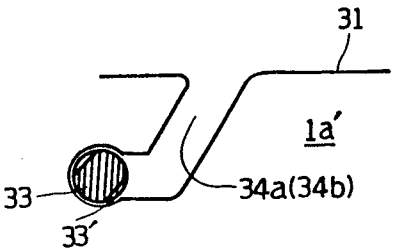
FIG. 7 (*a*) and 7 (*b*) are respectively the lateral views of essential coupling parts for explaining an engaging action of the cleaning unit of FIG. 6 with the copying apparatus.
Figure 6A:
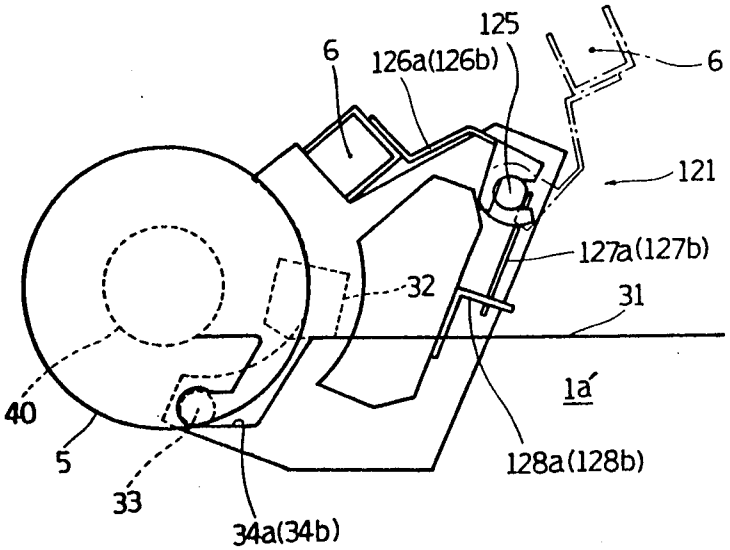
Figure 7A:
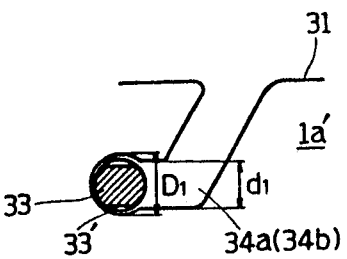

Like the first preferred embodiment, the frames 1a' and 1a' of the stationary part 1a of the copying apparatus are respectively provided with the guide rails 31 and 31 which extend themselves in the horizontal direction as shown in FIGS. 6 and 8. The guide pieces 32 and 32 coming into contact with said guide rails 31 and 31 are secured to the external surfaces of said side plates 23a and 23b. The guide slits 34a and 34b are provided for said frames 1a' and 1a' for guiding the supporting pins 33 and 33 externally projecting from said side plates 23a and 23b and supporting these in their bosom as is shown in FIGS. 7(a) and 7(b). The guide slits 34a and 34b having width $d_1$ are respectively provided with a L-shape.

The bosoms of said guide slit 34a (34b) is formed with round shape having internal diameter which is slightly wider than external diameter $D_1$ of said supporting pin 33 as is shown in FIGS. 7(a) and 7(b). The bevelling 33' having width narrower than $d_1$ is provided for the edge of said supporting pin 33.

The guide slit 34a (34b) is composed of a level part in the bosom and a inclined part in the inlet. Width of the level part is identical to width $d_1$, while the inclined part is wider than $d_1$ and narrower than $D_1$ to allow said bevelling 33' to pass through this portion in the tilted state.

The supporting hole 41a is formed at an end of the frame 1a' as shown in FIG. 8. When the shaft 125 moves in the direction of the arrow X while the cleaning unit 121 is raised by the operator until the guide piece 32 comes into contact with the bearing 40 of the photoreceptive drum 5, an edge 125' of this shaft 125 is inserted into the supporting hole 41a.

As shown in FIGS. 8 and 9, the narrow-diameter portion 42a and the wide-diameter portion 42b are provided for the other edge of the shaft 125. As shown in FIG. 8, the supporting hole 41b (shown in FIG. 11 (a))

which allows entry of said wide-diameter portion 42b is provided for the frame 1a' which is opposite from the frame 1a' having the supporting hole 41a. The cutout portion 41b' which is obliquely open in the downward direction is connected to this supporting hole 41b. This cutout portion 41b' is slightly wider than said narrow-diameter portion 42a. These supporting holes 41a and 41b constitute a means for engaging and disengaging shaft in this preferred embodiment.

Next, sequential procedure for loading the cleaning unit 121 and the main charger 6 into the copying apparatus is described below.

When the cleaning unit 121 is out of the copying apparatus, as shown in FIGS. 8 and 10 (*b*), the handles 127a and 127b installed to the shaft 125 are respectively inserted in the short slits 129a'' and 129b''. When the shaft 125 supported by the supporting holes 125a and 125b is energized by the spring 130 in the direction of the arrow X, this shaft 125 become the state shown in FIGS. 8 and 9(*b*).

While this state is present, the operator loads the cleaning unit 121 being combined with the main charger 6 into the copying apparatus 1 of which the movable part 1b remains open as shown in FIG. 19.

Concretely, the operator loads the guide pieces 32 and 32 and the supporting shafts 33 and 33 onto the guide rails 31 and 31 of the frames 1a' and 1a' of the copying apparatus. This allows the cleaning unit 121 to be held by the guide pieces 32 and 32 and the supporting shafts 33 and 33. Then, the operator moves the cleaning unit 121 in the direction of the arrow Y shown in FIG. 8. This causes the supporting shafts 33 and 33 to be inserted into the guide slits 34a and 34b. As mentioned above, since the bevelling 33' shown in FIG. 7 is provided for both edges of the supporting shafts 33 and 33, these supporting shafts 33 and 33 can smoothly enter into the guide slits 34a and 34b until reaching the bosoms. This state is shown in FIG. 6 (*a*). When this state is present, the main charger 6 is apart from the photoreceptive drum 5 by a sizable distance. To compensate for this, the operator rotates the cleaning unit 121 in the direction of the arrow Z shown in FIG. 6 (*b*) at the position where the cleaning unit 121 is present. Operator keeps on rotating the cleaning unit 121 until the guide piece 32 come into contact with the bearing 40 of the photoreceptive drum 5. This indicates that the position at which the guide piece 32 come into contact with the bearing 40 exactly corresponds to the position at which the cleaning unit 121 is correctly set. Concurrently, the main charger 6 is also correctly set to a position at a proper distance against the photoreceptive drum 5. However, the main charger 6 can be set to the correct position only after moving itself furthermore in the direction at right angle to a paper surface in FIG. 6 (*b*).

While operator keeps on rotating the cleaning unit 121 until realizing the state shown in FIG. 6 (*b*), the supporting shaft 33 is also rotated until realizing the state shown in FIG. 7 (*b*). As a result, the supporting shaft 33 having external diameter $D_1$ cannot reach the bosom (having width $d_1$) of the guide slit 34a (34b), and thus, the cleaning unit 121 cannot be taken outside in presence of this state. When this state is present, the operator slightly moves the shaft 125 in the direction opposite from the arrowed direction X in resistance against force of the spring 130. This allows the handles 127a and 127b to be disengaged from the short slits 129a'' and 129b''. As a result, operator can transfer the handles 127a and 127b from the short slits 129a'' and 129b'' to the lengthy slits 129a' and 129b' by slightly rotating the shaft 125 in the clockwise direction as shown in FIG. 6 (*b*) (see FIG. 10 (*a*)). Consequently, the handle 127a (127b) is disengaged from the short slit 129a'' (129b''), and then, said handle 127a (127b) move themselves through the lengthy slit 129a' (129b') in the arrowed direction X shown in FIG. 8 until they reach positions beyond those positions restricted by the short slit 129a'' (129b'').

Figure 11A:
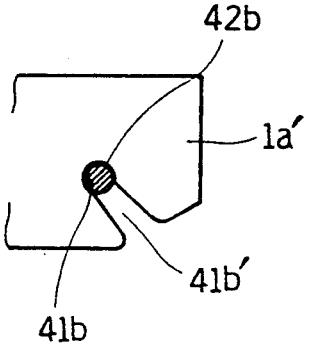
FIG. 11 (*a*) and 11 (*b*) are respectively the lateral views for explaining the constitution of the turning center portion of the main charger.
Figure 11B:
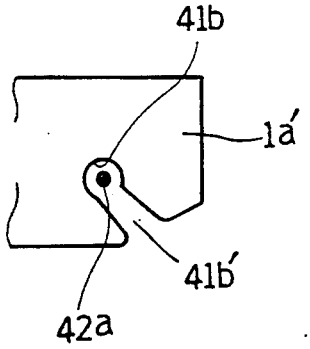

As this shaft 125 moves on, the tip end 125' of the shaft 125 is inserted into the supporting hole 41a. Simultaneously, the wide-diameter portion 42b at the opposite end of the shaft 125 is inserted into the supporting hole 41b, and as a result, the wide-diameter portion 42b cannot be disengaged from the cutout portion 41b'. FIG. 11 (*a*) represents this state. FIG. 11 (*b*) represents the state in which the narrow-diameter portion 42a is inserted into the supporting hole 41b through the cutout portion 41b'.

In this way, the shaft 125 is inserted into the supporting holes 41a and 41b, and yet, removal of the shaft 125 from these holes is securely prevented. This allows the cleaning unit 121 to firmly be fixed in position in presence of the state shown in FIG. 6 (*b*). Since the shaft 125 moves in the direction of the arrow X, the terminal 6b (connector means) of the main charger 6 is inserted into the socket (not shown) on the part of the copying apparatus, and thus, the main charger 6 is secured to the position shown in FIG. 6 (*b*).

By reversing those sequential processes mentioned above, integrally combined unit of the cleaning unit 121 and the main charger 6 can be removed from the copying apparatus. This securely promotes efficiency for executing the maintenance or the inspection of the cleaning unit 121 or the main charger 6.

Next, the process for opening the main charger 6 loaded in the copying apparatus for the cleaning is described below.

First, using the handles 127a and 127b, the operator moves the shaft 125 in the direction opposite from the arrowed direction X as shown in FIG. 8 by reversing those processes mentioned above. This causes the terminal 6b of the main charger 6 to be disengaged from the socket (not shown). Simultaneously, the tip end 125' of the shaft 125 is disengaged from the supporting hole 41a, while the wide-diameter portion 42b of the other tip end of the shaft 125 is also disengaged from the supporting hole 41b, and instead, the narrow-diameter portion 42a is inserted into the supporting hole 41b as shown in FIG. 11 (*b*). Thus, the shaft 125 is freed from the supporting holes 41a and 41b. As a result, the cleaning unit 121 can be rotated in the direction opposite from the direction of the arrow Z shown in FIG. 6 (*b*), to cause the guide piece 32 to leave the bearing 40 and then come into contact with the guide rail 31 as shown in FIG. 6 (*a*). Rotation of the cleaning unit 121 allows the main charger 6 to leave other parts like cover of light source 3 shown in FIG. 19 for example so that no interference can be generated by these parts. Consequently, the main charger 6 can be rotated by pivoting the shaft 125 up to the predetermined position shown by one-dot chained line of FIG. 6 (*a*). Finally, an opening of the main charger 6 turns upward to allow the operator to easily clean the main charger 6.

By reversing those processes mentioned above, the opened main charger 6 can be closed and the cleaning unit 121 can easily be reinstated inside of the copying apparatus.

By virtue of the constitution offered by this preferred embodiment, the operator can easily perform cleaning of the main charger 6 at frequent intervals while keeping it in the state being loaded inside of the copying apparatus. This securely promotes efficiency of a cleaning operation.

The invention provides a useful cleaning unit which allows the operator to easily clean the main charger at frequent intervals while keeping it in the state being loaded inside of the copying apparatus, and the operator can easily load and unload the integrally combined unit of the cleaning unit and the main charger for efficiently and reasonably perform the maintenance and the inspection at frequent intervals, thus significantly promoting overall efficiency in performing cleaning, the maintenance, and the inspection.

After separating the main charger 6 from adjacent component parts by rotating the cleaning unit 121, the operator can turn the opening of the main charger 6 in the external direction by rotating the main charger 6 itself so that cleaning can easily be done. As a result, the operator no longer incurs inconvenience in performing cleaning of the main charger 6 caused by interference between the main charger 6 and adjacent component parts of the copying apparatus.

When either loading or unloading the cleaning unit 121 shown in FIG. 8 into or from the copying apparatus, normally, the operator grasps the cleaning unit 121 by holding the shaft 125 with thumb and the bottom of the cleaning unit body 22 with other fingers.

Figure 12B:
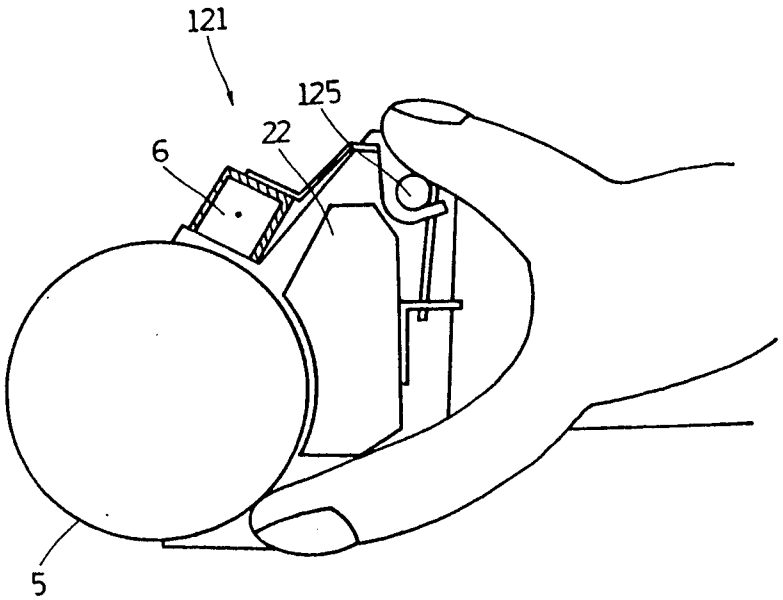
FIG. 12 (*a*) and, 12 (*b*) are respectively the lateral views of cleaning unit for explaining the state of the loading operation of the cleaning unit of another preferred embodiment shown in FIG. 6.
Figure 12A:
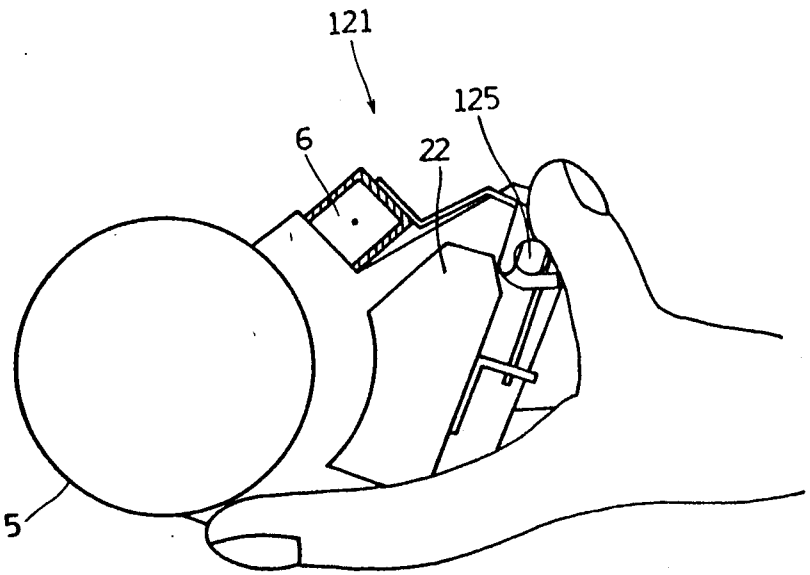

However, since there is no guiding object stopping the movement of fingers at the bottom of the cleaning unit body 22, the operator may deeply insert his fingers into the cleaning unit 121, and as a result, any of his fingers may come into contact with the surface of the photoreceptive drum 5 as shown in FIG. 12 (*a*) and (*b*).

On the other hand, the operator cannot easily grasp a cleaning unit if it has a sizable width. For example, if the operator holds the center of the cleaning unit body 22 with a single hand and the edge of either side with the other hand, due to unstable weight balance, the operator may feel it difficult to correctly load or unload the cleaning unit 121.

To solve this problem, the invention also provides another preferred embodiment of a cleaning unit having improved constitution which prevents fingers of the operator from coming into contact with the photoreceptive drum 5 when loading or unloading the cleaning unit 121 and provides convenience for the operator when holding cleaning unit having sizable width, the detail of which is described below.

The cleaning unit 221 which is offered by this preferred embodiment as shown in FIGS. 13 through 17 has a basic constitution similar to that of the cleaning unit 121 of the preceding embodiment shown in FIGS. 6 through 11. The cleaning unit 221 is provided with the stays 22*a* and 22*b* on both sides of the bottom of the cleaning unit body 22 for catching fingers when loading or unloading the cleaning unit 221 into or from the copying apparatus. This makes up the difference from the constitution of the cleaning unit 121 of the preceding embodiment.

Figure 13:
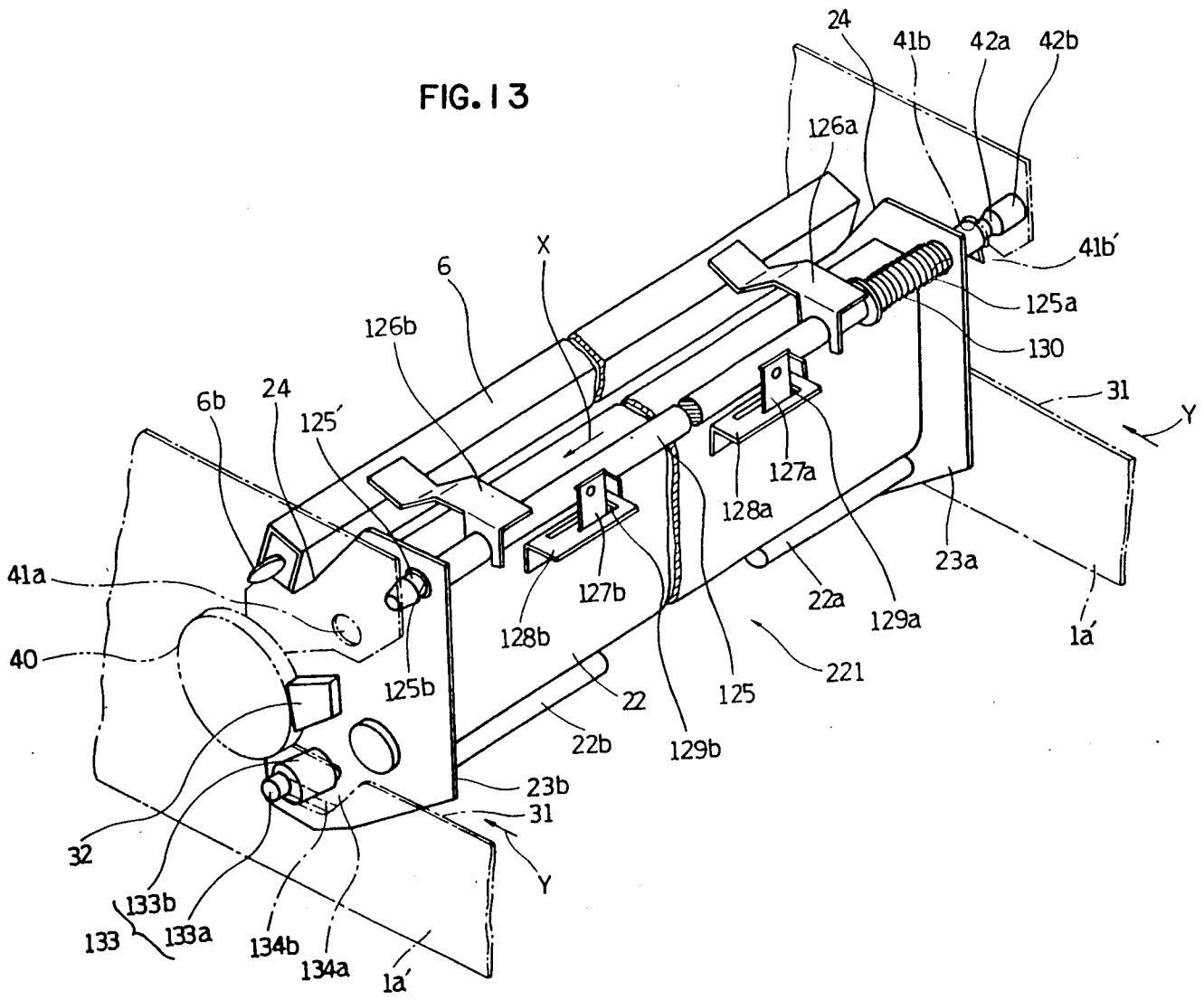
FIG. 13 is the perspective view of a still another preferred embodiment of the cleaning unit related to the invention.

Concretely, as shown in FIG. 13, the side plates 23*a* and 23*b* sandwiching the cleaning unit body 22 of the cleaning unit 221 of this preferred embodiment are respectively provided with the stays 22*a* and 22*b* which project therefrom. These stays 22*a* and 22*b* may substantially be set to both sides of the bottom of the cleaning unit body 22. Dimension of these stays may differ from each other. However, from the viewpoint of the balancing sense between both hands, desirably, these stays should be disposed in symmetry for right and left.

Further, the cleaning unit 221 of this preferred embodiment has said frames 1*a*' and 1*a*' which are respectively provided with the L-shaped guide slits 134*a* and the guide rib 134*b*, where the guide slit 134*a* guides the supporting shaft 133 which externally projects itself from said side plates 23*a* and 23*b* and the supports pin 133*a* of the supporting shaft 133, where the guide rib 134*b* supports the boss 133*b* of the supporting shaft 133, respectively.

Next, the Sequential procedure for loading the cleaning unit 221 above said into the copying apparatus is described below.

Figure 16A:
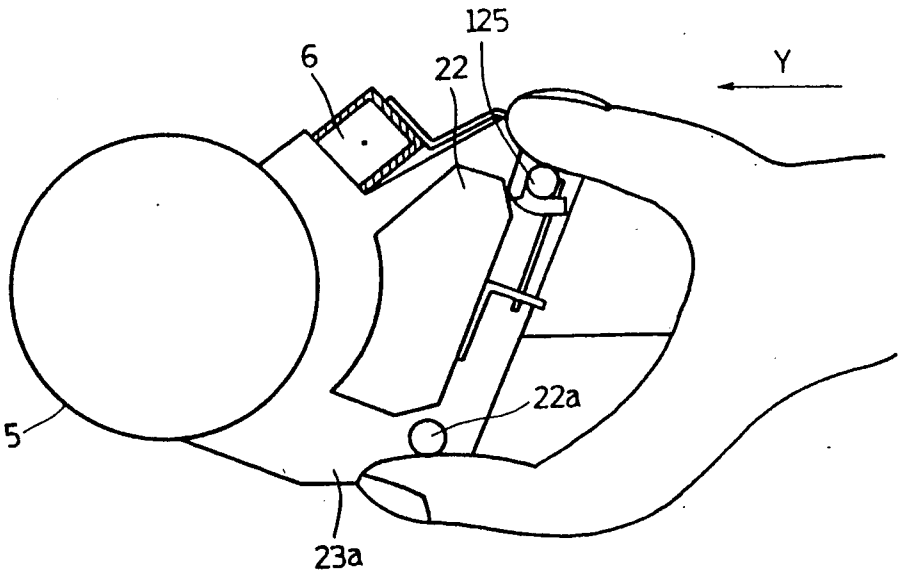
FIG. 16 (*a*) and 16 (*b*) are respectively the lateral views denoting the state of the loading operation of the cleaning unit shown in FIG. 13.
Figure 16B:
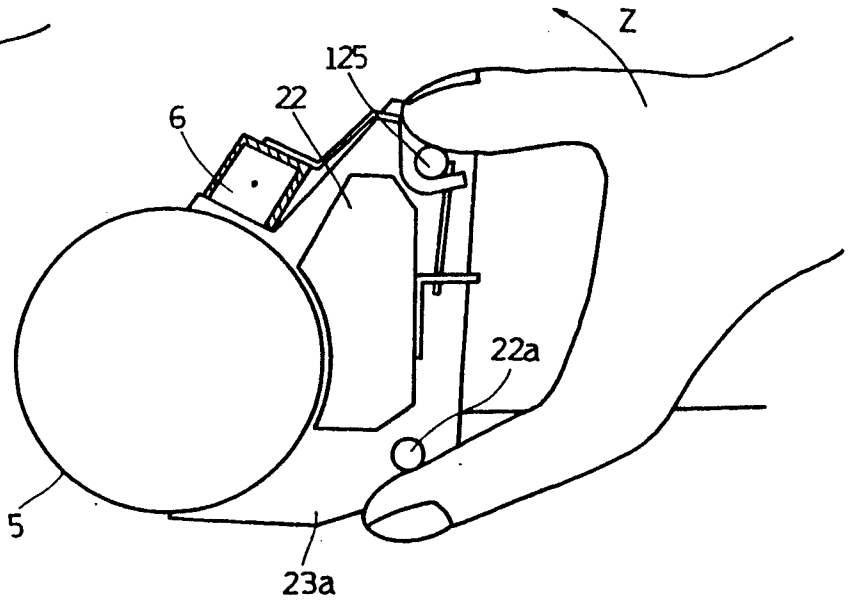
Figure 17A:
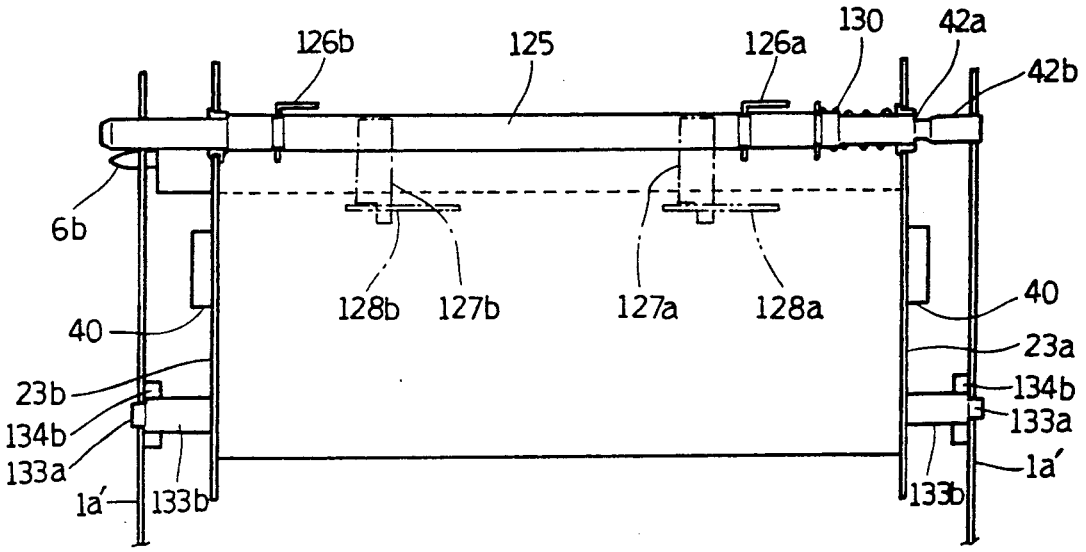
FIG. 17 (*a*) and 17 (*b*) are respectively the plane views for explaining the operations for loading the cleaning unit of the preferred embodiment shown in FIG. 13.
Figure 17B:
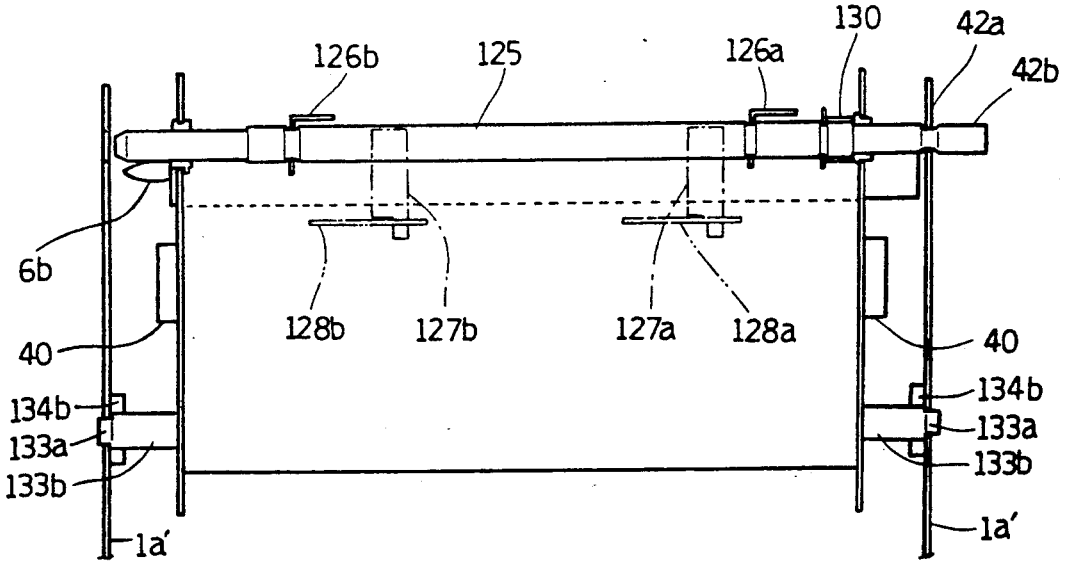

When the cleaning unit 221 is disengaged from the copying apparatus, the handles 127*a* and 127*b* installed to the shaft 125 are respectively engaged with the short slits 129*a*'' and 129*b*'' as shown in FIGS. 10 (*b*) and 13. When said shaft 125 held by the supporting holes 125*a* and 125*b* is energized in the direction of the arrow X by the spring 130, this shaft 125 become the state shown in FIGS. 13 and 17 (*b*). When this state is present, the operator manually holds the cleaning unit 221 integral with the main charger 6 using his fingers in contact with the stays 22*a* and 22*b* as shown in FIG. 16, and then, he loads the integral unit into the copying apparatus 1 through opening generated by the movable part 1*b*.

Figure 14B:
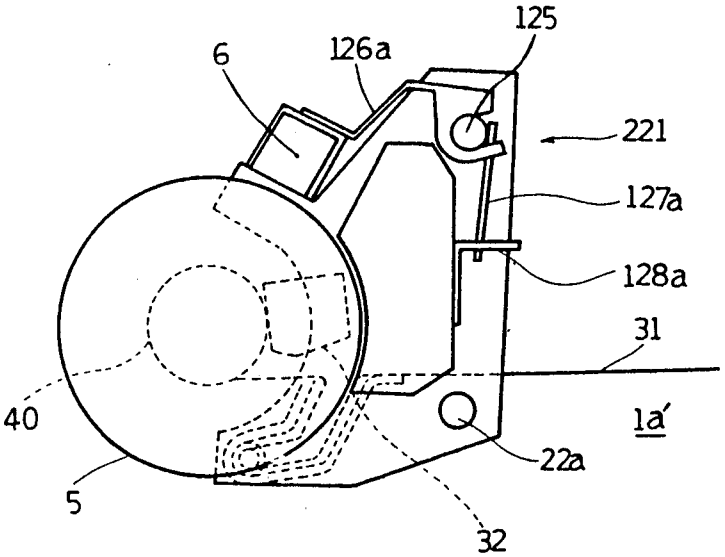
FIG. 14 (*a*) and 14 (*b*) are respectively the lateral views of a still another preferred embodiment of the cleaning unit denoting the operating condition.
Figure 14A:
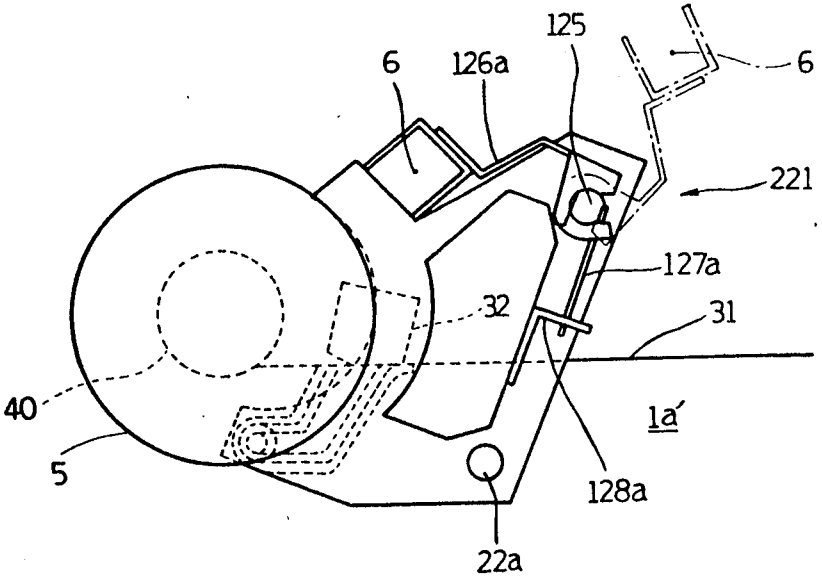
Figure 15B:
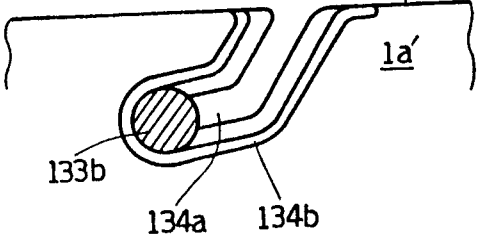
FIG. 15 (*a*) and 15 (*b*) are respectively the lateral views of essential coupling parts for explaining an engaging action of the cleaning unit of FIG. 13 with the copying apparatus.
Figure 15A:
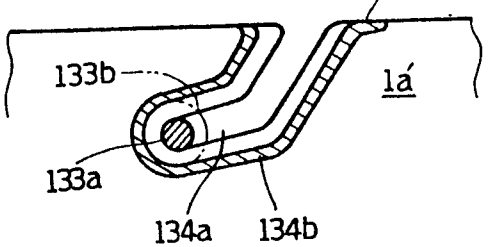

Concretely, first, the operator mounts the supporting shaft 133 on the guide rail 31 of the frame 1*a*'. Consequently, the cleaning unit 221 be held by these shaft 133. Then, the operator moves the cleaning unit 221 in the arrowed direction Y shown in FIG. 13. This causes the boss 133*b* of the supporting shaft 133 to be held by the guide rib 134*b*, and as a result, the pin 133*a* of the shaft 133 is inserted into the guide slit 134*a*. Since the guide rib 134*b* guides the boss 133*b*, the pin 133*a* can easily and smoothly enter into the bosom of the guide slit 134*a*. FIGS. 13, 14 (*a*), and 16 (*a*) respectively show this state. FIG. 15 (*a*) and (*b*) respectively show the state of the supporting shaft 133.

When the above state is present, the main charger 6 is apart from the photoreceptive drum 5 by a sizable distance. Then the operator rotates the cleaning unit 221 at this remote position in the direction of the arrow Z as shown in FIG. 16 (*b*). Afterwards, sequential procedure operations for loading similar to that of the cleaning unit 121 of the preceding embodiment are performed.

This preferred embodiment provides a novel cleaning unit for the copying apparatus, which can manually be loaded into and unloaded from the predetermined position close to the photoreceptive drum and features provision of a plurality of stays on both sides of the bottom of the cleaning unit body for catching fingers when either loading or unloading the cleaning unit. Consequently, the operator can stop the movement of his fingers at the position of these stays when grasping the cleaning unit, thus securely preventing his fingers from coming into contact with the surface of the photoreceptive drum. In addition, since stability of handling operation is promoted, the operator can easily load or unload a broad-width cleaning unit into or from the copying apparatus.

It should be understood that the constitution of the cleaning unit 221 related to this preferred embodiment is also applicable to the cleaning unit 21 (shown in FIG. 1).

What is claimed is:

1. A cleaning unit of a copying apparatus which allows a part of a photoreceptive drum and a cleaning unit located adjacent to said drum to be externally exposed by causing a part of the copying apparatus to move in a direction at a right angle to an axis of the photoreceptive drum comprising:

a shaft provided on said cleaning unit and freely slidable in a longitudinal direction of said cleaning unit and freely rotatable;

a main charger rotatably installed on said shaft and pivotally rotatable on said shaft;

energizing means for constantly energizing said shaft in one of longitudinal directions of said cleaning unit;

shaft-positioning means which sets a contact position of the shaft caused by the energizing means at two places;

shaft-engaging and disengaging means which allows both ends of said shaft to be engaged when said shaft is set at one of the contact positions and to be disengaged when said shaft is set in an other contact position; and connector means installed at an end of said main charger and inserted into a socket of the copying apparatus when said main charger is set to the former contact position together with said shaft so that said main charger can securely be mounted.

2. A cleaning unit of a copying apparatus which can be divided into a stationary part including a photoreceptive drum, a cleaning unit and a main charger integrally mounted on the cleaning unit, and a movable part slidably mounted at the stationary part, and in which a part of the photoreceptive drum and the cleaning unit mounted in the vicinity thereof can be externally exposed by causing said movable part to move against the stationary part in a direction at a right angle to the axis of the photoreceptive drum, comprising;

guide rails and guide pieces slidably contacted therewith, attached to said stationary part and said cleaning unit, and for guiding the cleaning unit in a direction at a right angle to the photoreceptive drum axis with the opening thereof opposed to said photoreceptive drum turned obliquely upwards, engaging portions and engaged portions, attached to said stationary part and said cleaning unit, and engageable with each other, which can become a fulcrum of rotation when rotating said cleaning unit from the position where said guide rails are slidably brought into contact with said guide pieces to the copying operation position where the cleaning member is slidably brought into contact with said photoreceptive drum, and locking means for fixing said cleaning unit at said stationary part at the position where the cleaning member thereof is slidably brought into contact with said photoreceptive drum.

3. A cleaning unit of a copying apparatus as claimed in claim 2, wherein either one of said engaging portions or engaged portions consists of a notch, and the other thereof consists of a pin which can be engaged with said notch.

4. A cleaning unit of a copying apparatus as claimed in claim 2, wherein said locking means comprises axes provided at the cleaning unit and a locking portion and a hole provided at said stationary part.

5. A cleaning unit of a copying apparatus as claimed in claim 2, wherein a part of said cleaning unit is brought into contact with a bearing of said photoreceptive drum when said cleaning unit rotates around said engaging portion (or said engaged portion) to the copying operation position of said cleaning unit, thereby causing said cleaning unit to be positioned.

6. A cleaning unit of a copying apparatus as claimed in claim 2, wherein said locking means comprises a main charger slidably installed at the cleaning unit in the lengthwise direction thereof and a main charger engaging portion mounted at said stationary part, for fixing said cleaning unit at said stationary part by engaging a part of said main charger by sliding said main charger after rotating said cleaning unit to said copying operation position.

7. A cleaning unit of a copying apparatus as claimed in claim 6, wherein a terminal is provided at the leading edge of said main charger, a connector is provided at the stationary part, and said connector is linked together with said terminal by sliding said main charger, thereby causing the cleaning unit to be fixed.

8. A cleaning unit of a copying apparatus as claimed in claim 2, wherein said locking means consists of a control member which is engaged with a shield case of a main charger in order to fix said cleaning unit at said stationary part.

9. A cleaning unit of a copying apparatus as claimed in claim 8, so composed that a protrusion can be provided at said control member, a notch can be provided at said shield case, said protrusion can pass through said notch when moving in a direction at a right angle to the axial center of the photoreceptive drum of the cleaning unit and sliding of the main charger can be interrupted by said protrusion after said sliding of the main charger is completed.

10. A cleaning unit of a copying apparatus which can be divided into a stationary part including a photoreceptive drum, a cleaning unit and a main charger integrally mounted on the cleaning unit, and a movable part slidably mounted at the stationary part, and in which a part of the photoreceptive drum and the cleaning unit mounted in the vicinity thereof can be externally exposed by causing said movable part to move against the stationary part in a direction at a right angle to the axis of the photoreceptive drum, comprising:

guide rails and guide pieces slidably contacted therewith, attached to said stationary part and said cleaning unit, and for guiding the cleaning unit in a direction at a right angle to the photoreceptive drum axis with the opening thereof opposed to said photoreceptive drum turned obliquely upwards;

engaging portions and engaged portions, attached to said stationary part and said cleaning unit, and engageable with each other, which can become a fulcrum of rotation when rotating said cleaning unit from the position where said guide rails are slidably brought into contact with said guide pieces to the copying operation position where the cleaning member is slidably brought into contact with said photoreceptive drum; and locking means for fixing said cleaning unit at said stationary part at the position where the cleaning member thereof is slidably brought into contact with said photoreceptive drum, wherein said main charger is rotatably installed at said cleaning unit, and said main charger can be opened by rotating it in the same direction as that of the cleaning unit only when the cleaning unit is opened by rotating in a direction away from the photoreceptive drum.

11. A cleaning unit of a copying apparatus as claimed in claim 10, wherein either one of said engaging portions or engaged portions consists of a notch, and the other thereof consists of a pin which can be engaged with said notch.

12. A cleaning unit of a copying apparatus as claimed in claim 10, wherein said locking means comprises axes provided at the cleaning unit and a locking portion and a hole provided at said stationary part.

13. A cleaning unit of a copying apparatus as claimed in claim 10, wherein a part of said cleaning unit is brought into contact with a bearing of said photoreceptive drum when said cleaning unit rotates around said engaging portion to the copying operation position of said cleaning unit, thereby causing said cleaning unit to be positioned.

14. A cleaning unit of a copying apparatus as claimed in claim 10, wherein said locking means comprises a main charger slidably installed at the cleaning unit in the lengthwise direction thereof and a main charger engaging portion mounted at said stationary part, for fixing said cleaning unit at said stationary part by engaging a part of said main charger by sliding said main charger after rotating said cleaning unit to said copying operation position.

15. A cleaning unit of a copying apparatus as claimed in claim 14, wherein a terminal is provided at the leading edge of said main charger, a connector is provided at the stationary part, and said connector is linked together with said terminal by sliding said main charger, thereby causing the cleaning unit to be fixed.

16. A cleaning unit of a copying apparatus as claimed in claim 10, wherein said locking means consists of an axis on which the main charger is integrally mounted and which can be engaged with the stationary part by sliding in the lengthwise direction thereof.

17. A cleaning unit of a copying apparatus as claimed in claim 16, wherein the main charger rotates centering around said axis.

* * * * *